US010786747B2

(12) United States Patent
Choi et al.

(10) Patent No.: US 10,786,747 B2
(45) Date of Patent: Sep. 29, 2020

(54) FILAMENTS HAVING CHANGEABLE SHAPE FOR A TOY OR ACCESSORY

(71) Applicant: Dongguan Silverlit Toys Co., Ltd., Dongguan (CN)

(72) Inventors: Kei Fung Choi, Causeway Bay (HK); Kwok Leung Wong, Causeway Bay (HK)

(73) Assignee: DONGGUAN SILVERLIT TOYS CO., LTD., Dongguan (CN)

( * ) Notice: Subject to any disclaimer, the term of this patent is extended or adjusted under 35 U.S.C. 154(b) by 0 days.

(21) Appl. No.: 16/510,691

(22) Filed: Jul. 12, 2019

(65) Prior Publication Data

US 2020/0023284 A1 Jan. 23, 2020

Related U.S. Application Data

(60) Provisional application No. 62/701,176, filed on Jul. 20, 2018.

(51) Int. Cl.

| | |
|---|---|
| ***A63H 3/44*** | (2006.01) |
| ***D02G 1/20*** | (2006.01) |
| ***D02G 1/02*** | (2006.01) |

(52) U.S. Cl.

CPC ..... *A63H 3/44* (2013.01); *D02G 1/02* (2013.01); *D02G 1/20* (2013.01)

(58) Field of Classification Search

CPC ... A63H 3/00; A63H 3/20; A63H 3/36; A63H 3/44

USPC ..... 446/391, 394

See application file for complete search history.

(56) References Cited

U.S. PATENT DOCUMENTS

| | | | | |
|---|---|---|---|---|
| 8,602,835 | B1 * | 12/2013 | Zwiers | A63H 3/44 446/394 |
| 2008/0171489 | A1 * | 7/2008 | Kim | A63H 3/44 446/394 |
| 2008/0293324 | A1 * | 11/2008 | Friedland | A63H 3/20 446/297 |
| 2008/0293326 | A1 * | 11/2008 | Ishimura | A63H 3/44 446/372 |

* cited by examiner

*Primary Examiner* — Kien T Nguyen

(74) *Attorney, Agent, or Firm* — Greenberg Traurig, LLP

(57) ABSTRACT

Hair for a doll, toy or a wearable item is reversibly stylable. The hair can change between straight and curly hair by subjecting the hair to a change of temperature. This temperature change can be by the application of heat, coolness or cold. In one form, then, straighten of curved doll hair filaments is through hot air or hot water. (38-40 degrees). A doll figure can include auto fitting smart hair filaments for practicing the method. Pulling straight doll hair turns the hair to curly. Straightening is affected through heat. The doll has hair filaments which are formed by shape memory plastic material.

25 Claims, 6 Drawing Sheets

Loop Diameter after Pull

A = 18mm-20mm
B = 5.0mm-10mm
C = 4.0mm-6.0mm
D = 14mm-16mm
E = 3.5mm-4.0mm
F = 2.6mm-2.9mm
G = 7.0mm-10mm
H = 3.0mm-3.2mm
I = 1.8mm-2.2mm
J = 5.0mm-8.0mm
K = 2.3mm-2.9mm
L = 1.6mm-2.0mm

FILAMENTS HAVING CHANGEABLE SHAPE FOR A TOY OR ACCESSORY

CROSS-REFERENCE TO RELATED APPLICATION

This application relates to U.S. provisional application 62/701,176 filed Jul. 20, 2018 and entitled TOY WITH STYLABLE HAIR. Priority is claimed from that application and its contents are incorporated by reference entirely and in whole in this present application.

BACKGROUND

The disclosure relates to a toy or accessory item. In one form, as a toy there is included a representation of a human or animal figure or a doll. In another form as an accessory item there is an ornamental characteristic provided for instance to an item of fashion.

SUMMARY

Elongated filaments are provided on a toy or accessory which includes a base for mounting the elongated filaments. The filaments can change between an essentially straight and essentially curly shapes or formats by subjecting the filaments to a change of temperature. This temperature change can be by the application of heat. The application of heat causes a curly filament to become straighter. Reversibly, a straighter or straight filament can be rendered curly by applying tensile stress to the filament.

An element to be worn or carried on a person can include a variable multi-filament group which is mounted on a body. The straightness or curliness of the filaments is by a memory material of the filament. The normal state of the filaments, prior to heating and after a tensile force is applied is curled. The degree of tensile stress and length of time of tensile stress varies the degree of curliness imparted to the filaments.

A child can use this toy to enhance the playing with toy dolls. The toy can be a human and animal figurine As an accessory item there may an item for use on or with a toy. The item can be for use as a wearable item of adornment, covering, clothing or with clothing or a fashion item for wearing on the human or animal body.

DRAWINGS

The above-mentioned features and objects of the present disclosure will become more apparent with reference to the following description taken in conjunction with the accompanying drawings wherein like reference numerals denote like elements and in which:

FIG. 1*a* depicts five exemplary different cross sections of a filament, such as to represent hair. The cross-sections can be circular or rectangular or combinations of these shapes as appropriate a toy or accessory item.

FIG. 1*b* are three representative cross-sectional front views through about the middle of different heads of a toy showing different sizes, numbers and arrangements of apertures for receiving or planting hair filaments with the head. There can be a single centrally located aperture on the head for reeving a bunch of filaments as show in Type 1. In Type 2 there are apertures spread out and spaced over about 120 degrees of the head circumference. In Type 3 the apertures are more bunched together and cover about 90 degrees of the head circumference.

FIG. 1*c* depicts three different cross sections of hair which can be circular or rectangular or combinations of these shapes as appropriate for the toy in the three different heads of a toy of FIG. 1*b* and showing different numbers and arrangements of apertures for receiving hair filaments.

FIG. 2*a* depicts general hair play with hair on a head about to be pulled by the fingers of a hand.

FIG. 2*b* depicts general hair play with hair on a head being pulled by the fingers of a hand.

FIG. 2*c* depicts general hair play with hair on a head released after being pulled by the fingers of a hand.

FIG. 3*a* depicts curled hair being placed in warm water for straightening.

FIG. 3*b* depicts hair after being placed in warm water shown in the straightened form.

FIG. 3*c* depicts curled hair being subjected to warm air from a dryer for straightening.

FIG. 3*d* depicts hair after being subjected to the warm air shown in the straightened form.

FIG. 4*a* represents graphically the pull and hold of hair in seconds as compared to the net effect of the curl on the hair. The y axis represents the time of the pull and hold duration in seconds, and the x axis represents the percentage of elongation. The longer the pulling time in seconds the curlier become the filaments or hair. The greater the tensile pull and hold or stress, the curlier become the filaments or hair.

FIG. 4*b* represents the loop diameter of the curl after the pull as represented by the different parameters of FIG. 4*a*. The less the tensile stress and the shorter the time of application of the tensile stress the larger the diameter of the loop of the curl. The greater the tensile stress and the longer the time of application of the tensile force the smaller the diameter of the loop of the curl FIG. 5 represents a doll with different before and after hair styles, partly curled and partly straight, and different accessories. There can be style up hair, soft rubber snap on clothes. The doll look Options can vary. There can be two- or more tones of hair color, and the filaments can be braided and have some clips put on them.

FIG. 6 represents a doll with different before and after hair styles, partly curled and partly straight, and different convertible, interchangeable and removable body parts and accessories.

FIG. 7 represents a doll with different before and after hair styles, partly curled and partly straight, and a configuration where in the hair straight state a selected larger portion of the figurine, including extending limbs is hidden and in the curled hair state the selected larger portion, including extending limbs of the figurine is shown. The extended limbs include at least one of arms, hands, legs and feet.

DETAILED DESCRIPTION

Figure 1A:
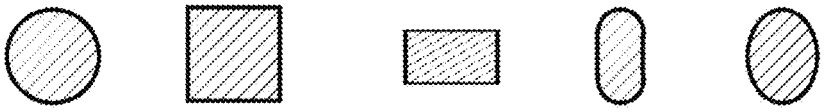
Figure 1B:
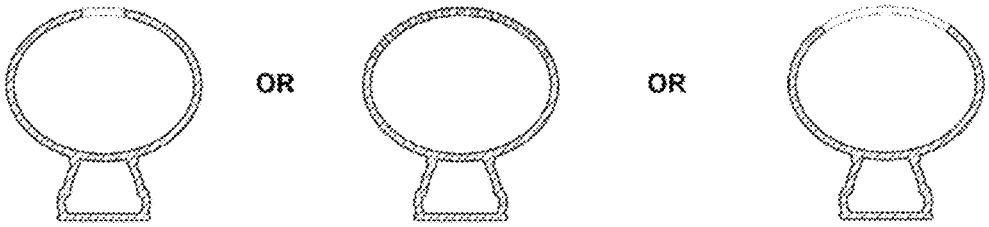
Figure 1C:
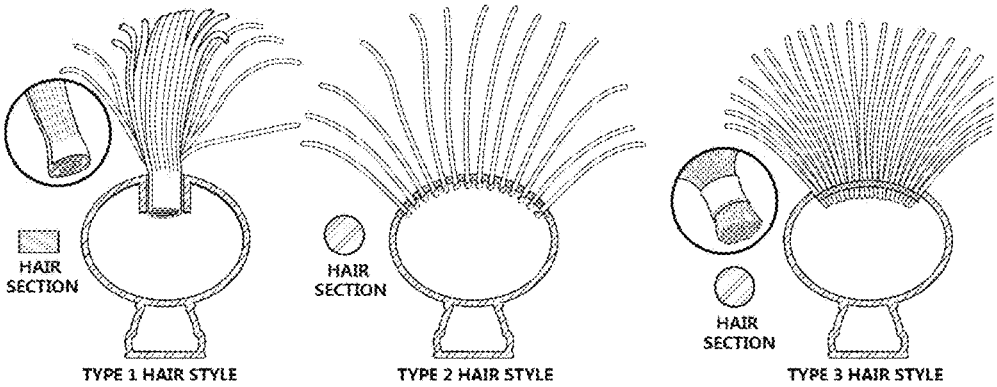
Figure 2A:
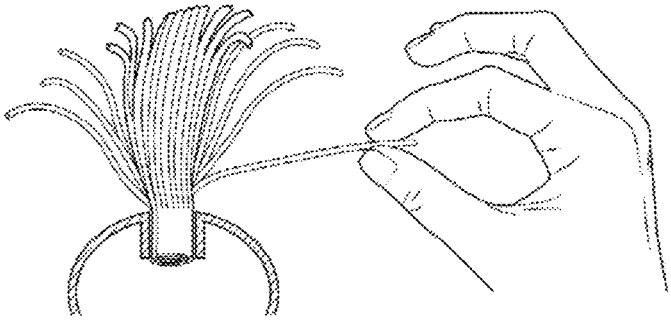
Figure 2B:
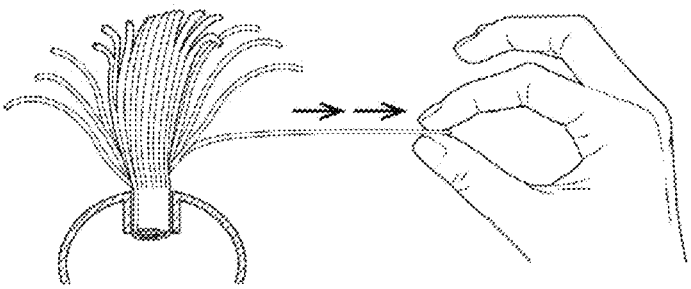
Figure 2C:
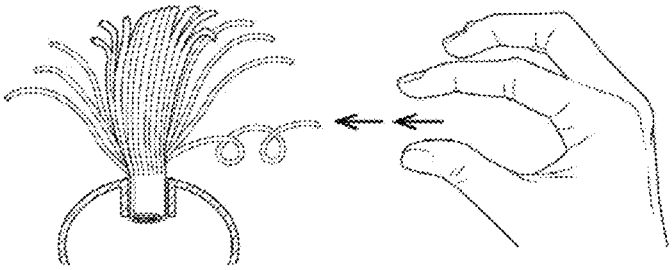
Figure 3A:
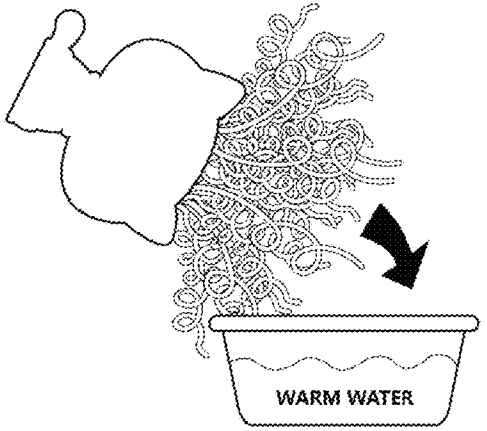
Figure 3B:
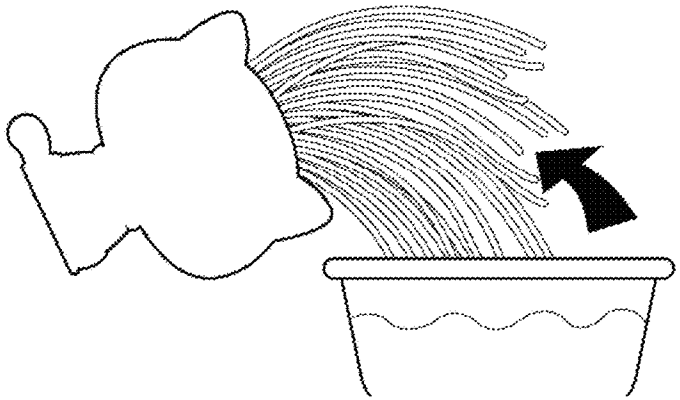
Figure 3C:
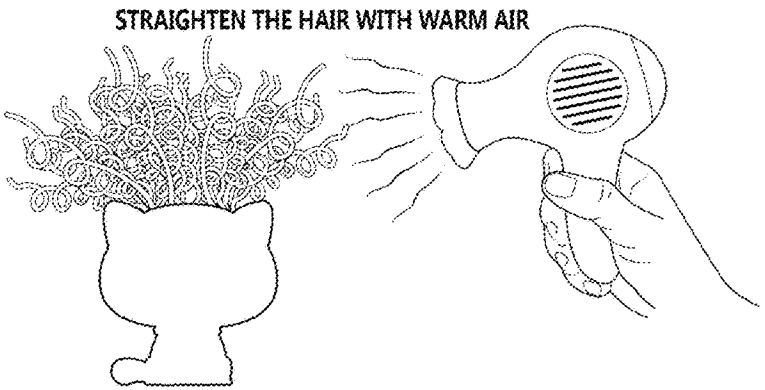
Figure 3D:
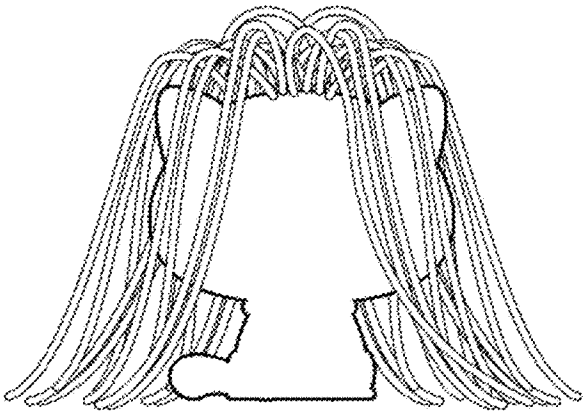
Figures 4A, 4B:
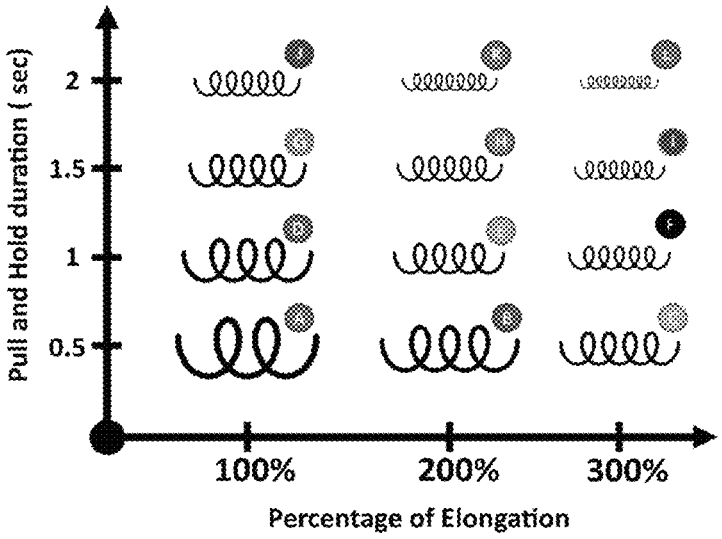
Figure 5:
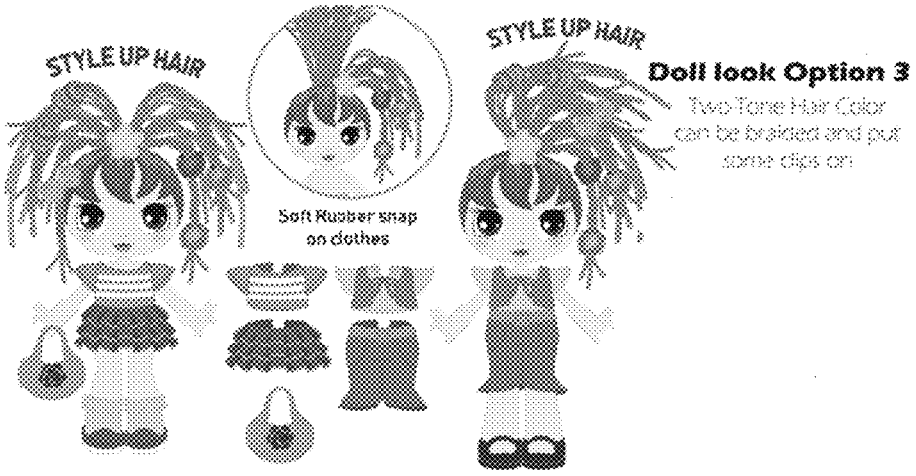
Figure 6:
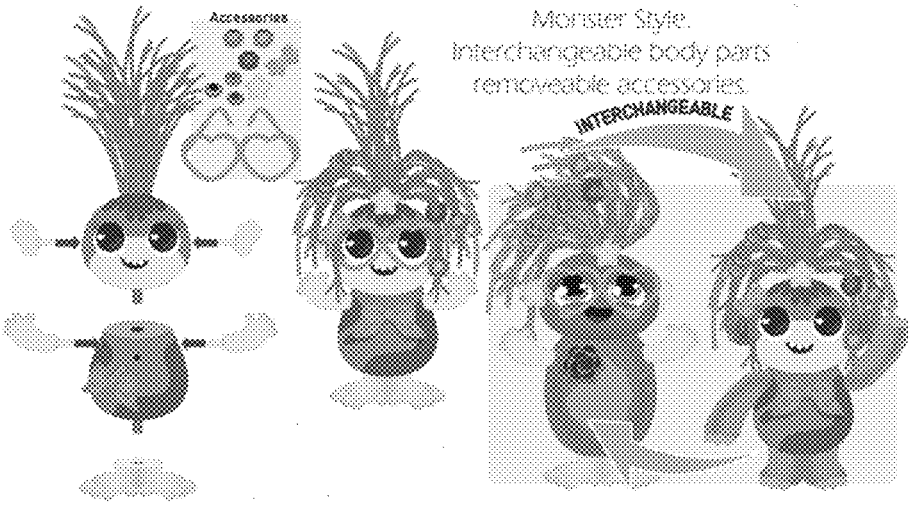
Figure 7:
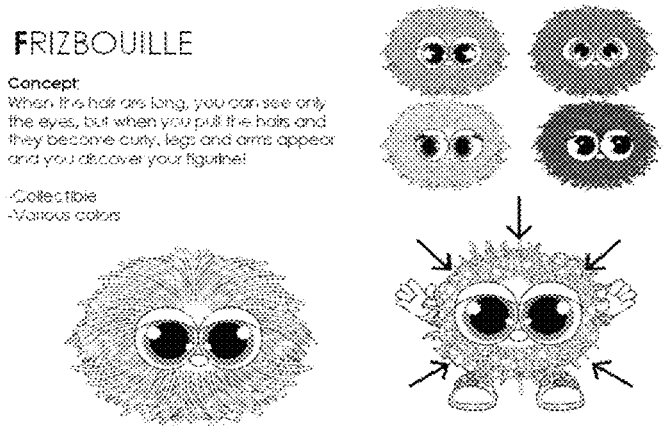
Figure 8:
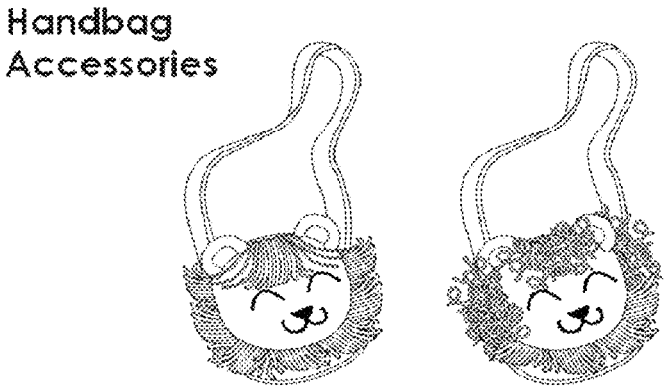
FIG. 8 represents an accessory item, namely a handbag, with filaments or hair with different before and after hair styles, partly curled and partly straight.
Figure 9:
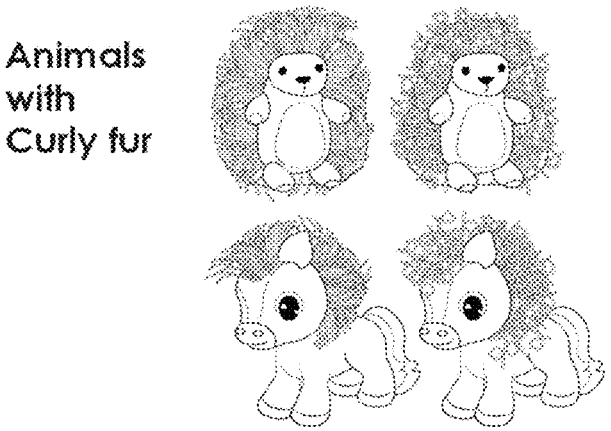
FIG. 9 represents different animal dolls with different before and after hair styles, partly curled and partly straight on a lesser or greater part of the animal body.

The disclosure relates to elongated filaments for exposure on a toy or accessory. There is a base for mounting one end of the elongated filaments. The opposite end being essentially freely disposed or unmounted. The filaments are changeable between an essentially straight shape and an essentially curly shape by the application of physical tensile force on the filaments. Also a change of temperature around an about the filaments effects the shape. As such the elements hereby affect the adoption of different ornamental positions of the filaments relative to the base of the toy or accessory.

An elongated filament group for exposure on a toy or accessory, comprising a base for mounting one end of the elongated filaments, the opposite end being essentially freely disposed or unmounted. The filaments are changeable between an essentially straight shape and an essentially curly shape by the application of physical tensile force on the filaments and a change of temperature around an about the filaments. This affects the adoption of different ornamental positions of the filaments relative to the base of the toy or accessory.

The filaments are in a group or series or bunch. In the straightened arrangement they can be relatively or largely parallel to each other to present a straight hair or filament group. In the curled relationship they can appear as jumbled mix. The group can include a collection of partly parallel (straight), and/or partly curled, and/or wholly straight and/or wholly curled filaments accord to the preferred styling or choice of a user.

The filaments are responsive to a change of temperature, selectively the application of heat, changes the degree of straightness or curliness of the filaments.

The body is for the toy, and a stylable variable hair arrangement effected by the filaments. The body is part of the base, and the filaments are formed from a memory material, and a straightness or curliness of the filaments is achieved by the effect of the memory material or filament.

The normal state of the hair, prior to heating and after a tensile force is applied is a curled state. The degree of tensile stress and length of time of tensile stress vary the degree of curliness imparted to the hair. The temperature of exposure to the hair caused the degree of curliness or straightness to vary reversibly. Heating the hair causes the tensile force causing curling to be released and the hair to return to its uncurl or straight condition.

In one form a toy comprising a body, a stylable variable hair arrangement which is mounted on the body. The hair is formed by a group of filaments, and the straightness or curliness of the hair is affected by a memory material of the hair.

In another form, an element to be worn or carried on a person includes a stylable variable multi-filament arrangement which is mounted on a body. The straightness or curliness of the filament is by a memory material of the filament. The straightness or curliness of the filaments is affected by a memory material of the filament.

The element as claimed in claim 12 including having the level or temperature or quantity of heat applied vary the amount or degree of straightness to which the filament returns.

In one form of the disclosure there is a toy that has one or more body parts, for instance a head which normally holds hair. There can be many different kinds of hair styles on the body. The hair is stylable to adopt different shapes by having the hair filaments to change shape under different ambient conditions in and/or about the hair filaments.

The present disclosure presents a toy and/or accessory that has a reversible stylable, variable hair arrangement which is mounted on the body, where the straightness or curliness of the hair is by a memory material or filament. The temperature of exposure to the hair caused the degree of curliness or straightness to vary. Subjecting the material to a different temperature permits the material or filament to return to its state prior to being changed. The normal state of the hair, prior to heating and after a tensile force is applied is to be curled.

Heating causes the tensile force causing curling to be released and the hair to return to its uncurl or straight condition. The level or temperature or quantity of heat applied can vary the amount or degree of straightness to which the hair returns. Similarly, the degree of tensile stress and length of time of tensile stress can vary the degree of curliness imparted to the hair.

The toy includes at least one doll with doll's hair which is stylable. The hair can change between straight hair and curly hair by subjecting the hair to a change of temperature. This temperature change can be by the application of heat.

In one form, the straightening of the curved or curly doll hair filaments is through hot air or hot water, for instance at a temperature of about 38-40 degrees. Pulling the straight doll's hair, turns the hair to curly. Straightening can be affected through heat. The doll has filled up hair filaments which are formulated by shape memory plastic material. The hair filament can be turned curly after being stretched within 1-3 times of its original length. The curly loop diameter will be varied after applying a different stretch force and time duration.

Heating can be applied using hot air (e.g. hair dryer) to blow the curly hair loop or dipping the filaments inside hot water (e.g. 38-40 deg. Celsius) for a few seconds. The curly hair gets back to original straight condition, which can be simultaneously so that the different style is achieved.

The doll figure can include auto fitting smart hair filaments of the memory material for practicing the method. A method and means for styling hair in a satisfying manner are thus provided.

The filaments are of a nature that to pull straight doll hair causes them to curl, and straighten is through heat applied to the filaments.

A method for styling doll's hair includes the step to turn straight doll hair curly, and reversibly turn curly hair straight.

The doll has filled up hair filaments which are formulated by shape memory plastic material. The doll hair filament can be turned curly after being stretched within 1-3 times of its original length. The curly loop diameter will be varied after applying different stretched force and duration.

A method and means for styling hair in a satisfying manner are thus provided.

Other features of the disclosure include:

1. The hair filament can have different colors and smell.
2. The hair filament can be a laminated plastic material.
3. The recovery speed of filament can be less than 1 minute: the recovery speed of filament depends on filament temperature and time. The higher the temperature, the faster the recovery speed. Similarly, the longer the duration above critical temp which is around 40 deg. Celsius, the faster the recovery time. The hot water temperature could be within 40 to 70 deg. Celsius. If the filament is kept above 70 deg. for certain period of time, says, 10 minutes, the shape memory property may be degraded
4. Based on the characteristics of Shape Memory Polymer (SMP), it is allowed to change from one shape to another shape by temperature change. Straight and curly are 2 typical shapes only. Other shapes include wavy and spiral coiled, etc.
5. In the toy application, the temperature for effecting change, for instance the hot water temperature be about <70 deg. Celsius. Hot water is just one example a media for raising the filament temperature. Other accessories for heat generation include hair dryer, heater, hand warmer or Infrared lamp, etc.

6. Application of SMP is not limited on doll hair, it can also be applied in animal hairs of stuffed toy. In this sense the term "doll" can mean any toy structure which can be a base for having hair features which can extend from the body.

A feature of the disclosed concept is a cute doll or pet with stylable hair, "magic" hair, which can be loop-like hair. In one form, just pulling the hair will turn the hair to a curly shape. Different pull force can create a different curly effect.

One or more dips of the curly hair in the warm media (fluid or gas) or condition, can change the curly hair back to straight hair.

In another form, placing the doll or pet on the stylish saloon style chair can act to dry the hair. This can be by automated seating or by pushing a fan button. The stylish chair can recognize the pet and have funny SFX or other special effects. There can be a try me package (e.g. try push the hair). There can be many hair stylish accessories for different play sets.

Different aspects of the curled, looped and straight hair are possible. There can be hair play characteristics with hair on a head for pulling and release by the fingers of a hand, and the application of heat media to the hair to affect straightening. There can be different heating media for use to straighten hair.

Configuration are possible where in the hair straight state, the figure is like a bouncing ball and in the curled hair state the larger portion. There can be limbs of the figurine, and the figurine can have a light source such as an LED source to be activated. Pulling the hair can cause different sound effects, noises, and movements of the doll.

While the toy, accessory and method have been described in terms of what are presently considered to be the most practical and preferred embodiments, it is to be understood that the disclosure need not be limited to the disclosed embodiments.

For instance, instead of a temperature change being used to affect straightening and pulling being used to affect curling, the reverse could be applied, namely the use of a temperature change to affect curling and pulling being used to affect straightening.

It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. An elongated filament group for exposure on a toy or accessory, comprising a base for mounting one end of the elongated filament group, an opposite end being essentially freely disposed or unmounted, the filament group being changeable between an essentially straight shape and an essentially curly shape, and by the application of physical tensile force on filaments in the filament group to affect curling, and by the application of a change of temperature around and about the filaments, thereby to affect the adoption of different ornamental position of the filaments relative to the base of the toy or accessory.

2. The filament group of claim 1 and including a body for the toy, a stylable variable hair arrangement effected by the filaments, the filaments being mounted on the body, and the body being part of the base, and wherein the filaments are formed from a memory material, and a straightness or curliness of the filaments is achieved by the effect of the memory material or filament.

3. An elongated filament group for exposure on a toy or accessory, comprising a base for mounting one end of the elongated filament group, an opposite end being essentially freely disposed or unmounted, the filament group being changeable between an essentially straight shape and an essentially curly shape by the application of physical tensile force on filaments in the filament group and a change of temperature around and about the filaments, thereby to affect the adoption of different ornamental positions of the filaments relative to the base of the toy or accessory, including a body for the toy, a stylable variable hair arrangement effected by the filaments, the filaments being mounted on the body, and the body being part of the base, and wherein the filaments are formed from a memory material, and a straightness or curliness of the filaments is achieved by the effect of the memory material or filament, and wherein the normal state of the hair, prior to heating and after a tensile force is applied is a curled state.

4. The filament group of claim 3 wherein subjecting the filaments to a change of temperature, selectively the application of heat, coolness or cold changes the degree of straightness or curliness of the filaments.

5. The filament group of claim 3 including having the degree of tensile stress and length of time of tensile stress vary the degree of curliness imparted to the hair.

6. An elongated filament group for exposure on a toy or accessory, comprising a base for mounting one end of the elongated filament group, an opposite end being essentially freely disposed or unmounted, the filament group being changeable between an essentially straight shape and an essentially curly shape by the application of physical tensile force on filaments in the filament group and a change of temperature around and about the filaments, thereby to affect the adoption of different ornamental positions of the filaments relative to the base of the toy or accessory, including a body for the toy, a stylable variable hair arrangement effected by the filaments, the filaments being mounted on the body, and the body being part of the base, and wherein the filaments are formed from a memory material, and a straightness or curliness of the filaments is achieved by the effect of the memory material or filament, and wherein the temperature of exposure to the hair causes the degree of curliness or straightness to vary reversibly.

7. An elongated filament group for exposure on a toy or accessory, comprising a base for mounting one end of the elongated filament group, the opposite end being essentially freely disposed or unmounted, the filament group being changeable between an essentially straight shape and an essentially curly shape by the application of physical tensile force on filaments in the filament group and a change of temperature around and about the filaments, thereby to affect the adoption of different ornamental positions of the filaments relative to the base of the toy or accessory, including a body for the toy, a stylable variable hair arrangement effected by the filaments, the filaments being mounted on the body, and the body being part of the base, and wherein the filaments are formed from a memory material, and a straightness or curliness of the filaments is achieved by the effect of the memory material or filament, and including heating the hair to cause the tensile force causing curling to be released and the hair to return to its uncurl or straight condition.

8. A toy comprising a body, a hair arrangement which is mounted on the body, the hair being formed by a group of filaments, the straightness or curliness of the hair is affected by a memory material of the hair, wherein the normal state of the hair is curled after a tensile force is applied and prior to heating, and wherein the degree of tensile stress and length of time of tensile stress varies the degree of curliness imparted to the hair.

9. The toy as claimed in claim 8 wherein the hair is stylable to adopt varies forms, and wherein the level or temperature or quantity of heat applied can vary the amount or degree of straightness of the hair.

10. The toy as claimed in claim 8 wherein the temperature of exposure to the hair causes the degree of curliness or straightness to vary reversibly.

11. The toy as claimed in claim 8 wherein including the toy being a doll, being selectively a human or animal representation or an accessory for a toy.

12. The toy as claimed in claim 8, wherein in the straight filament state the body is hidden by the filaments, and in the curled filament state, at least a portion of the body is visible.

13. An element to be worn or carried on a person including a variable multi-filament group which is mounted on a body, wherein the straightness or curliness of filaments in the filament group is by a memory material of the filaments, wherein the normal state of the filaments is curled after a tensile force is applied and prior to heating, and wherein the degree of tensile stress and length of time of tensile stress varies the degree of curliness imparted to the filaments.

14. The element as claimed in claim 13 wherein the temperature of exposure to the filaments causes the degree of curliness or straightness to vary.

15. The element as claimed in claim 13 wherein subjecting the material to a different temperature permits the filaments to return to the state prior to being changed.

16. The element as claimed in claim 13 wherein the normal state of the filaments is curled prior to heating and after a tensile force is applied.

17. The element as claimed in claim 13 including having the filaments respond to change of temperature, selectively heating, to cause relative curling to be released and the filaments to return to a relatively essential straight condition.

18. The element as claimed in claim 13 including having the level or temperature or quantity of heat applied vary the amount or degree of straightness to which the filament returns.

19. The element as claimed in claim 13 including having the degree of tensile stress and length of time of tensile stress varies the degree of curliness imparted to the filament.

20. An elongated shape memory material filament group for exposure on a toy or accessory, comprising a base for mounting one end of the shape memory material filament group to the toy or accessory, the opposite ends of the filaments of the filament group being essentially freely disposed or unmounted, the filaments of the filament group being changeable between an essentially curly shape and an essentially straightened by application of tensile force to the filaments in the filament group followed by release to effect curling of the filaments, thereby to affect the adoption of a curly shape ornamental position of the filaments relative to the base of the toy or accessory.

21. The filament group of claim 20 further comprising the filaments of the filament group being changeable from the curly shape to a straightened shape by heating the filaments in the filament group.

22. The filament group of claim 20 further comprising the filaments of the filament group being changeable from the straightened shape to curly shape by subjecting the filaments to another tensile stress for a period of time and then releasing the filaments to effect relaxation back to a curled shape.

23. The filament group of claim 22 wherein a degree of curliness id determined by degree of tensile stress and/or length of the stress period of time.

24. An elongated filament group for exposure on a toy or accessory, comprising a base for mounting one end of the elongated filament group, an opposite end being essentially freely disposed or unmounted, wherein the filament group is made of shape memory material filaments, the filaments of the filament group being changeable between an essentially straight shape and an essentially curly shape, and by the application of physical tensile force on filaments in the filament group to affect curling, and by the application of a change of temperature around and about the filaments, thereby to affect the adoption of different ornamental position of the filaments relative to the base of the toy or accessory.

25. An elongated filament group for exposure on a toy or accessory, comprising a base for mounting one end of the elongated filament group, an opposite end being essentially freely disposed or unmounted, the filament group being changeable between an essentially straight shape and an essentially curly shape, and by the application of physical tensile force on filaments in the filament group to affect curling of the filaments, thereby to affect the adoption of a curly shaped ornamental position of the filaments relative to the base of the toy or accessory.

* * * * *